United States Patent [19]

Johnson

[11] 4,101,394

[45] Jul. 18, 1978

[54] ELECTROLYTIC METHOD

[75] Inventor: Harlan B. Johnson, Rittman, Ohio

[73] Assignee: PPG Industries, Inc., Pittsburgh, Pa.

[21] Appl. No.: 774,308

[22] Filed: Mar. 4, 1977

Related U.S. Application Data

[63] Continuation-in-part of Ser. No. 575,915, May 9, 1975, abandoned.

[51] Int. Cl.[2] ..... C25B 1/26; C25B 1/02; C25B 3/04

[52] U.S. Cl. ..... 204/77; 204/98; 204/128; 204/73 R; 204/76

[58] Field of Search ..... 204/73 R, 77, 98, 128, 204/76

[56] References Cited

U.S. PATENT DOCUMENTS

| | | | |
|---|---|---|---|
| 2,543,763 | 3/1951 | Conner | 204/73 R |
| 3,103,473 | 9/1963 | Juda | 204/77 |
| 3,542,657 | 11/1970 | Mindler et al. | 204/98 |
| 3,607,686 | 9/1971 | Buecheler | 204/73 R |
| 3,635,804 | 1/1972 | Gritzner et al. | 204/128 |
| 3,658,667 | 4/1972 | Cobb et al. | 204/73 R |
| 3,756,930 | 9/1973 | Weiss et al. | 204/129 |

*Primary Examiner*—F.C. Edmundson
*Attorney, Agent, or Firm*—Richard M. Goldman

[57] ABSTRACT

Disclosed is a method of reducing the cathodic voltage of an electrolytic cell while electrolytically producing alcohols, aldehydes, acids, and ketones from peroxy bond-containing organic compounds such as peracids, peroxides, hydroperoxides, and derivatives thereof. According to the disclosed method, the peroxy bond-containing organic compound is fed to the catholyte compartment of an electrolytic cell and an aqueous chloride solution, e.g., sodium chloride or hydrochloric acid, is fed to the anolyte chamber of the cell while passing an electrical current from an anode of the cell to a cathode of the cell. Chlorine is recovered as the anodic product of the cell while the reaction products of the peroxy bond-containing organic compound are recovered as cathodic products. Also disclosed is a method of electrolyzing aqueous chloride solutions, e.g., sodium chloride solutions, and hydrochloric acid solutions at a reduced cell voltage. In addition to the steps of feeding the chloride solution to an electrolytic cell, passing an electrical current from an anode of the cell to the cathode of the cell, evolving chlorine on the anode of the cell, and recovering the chlorine gas from the anolyte chamber of the cell, the disclosed method also includes feeding an oxidant to the catholyte chamber of the cell and recovering cathodic reaction products of the oxidant, in addition to water and alkali metal hydroxides, from the catholyte chamber. Disclosed oxidants include organic compounds containing peroxy bonds such as peracids, peroxides, hydroperoxides, and their derivatives where the cathodic reaction products of the oxidant are alcohol, ketone, aldehyde, or acid corresponding to the peroxy-containing organic oxidant.

18 Claims, No Drawings

ELECTROLYTIC METHOD

CROSS-REFERENCE TO RELATED APPLICATION

This is a continuation-in-part of my commonly assigned, copending U.S. application Ser. No. 575,915, filed May 9, 1975, now abandoned, for PRODUCTION OF TERTIARY BUTYL ALCOHOL BY CATHODIC REDUCTION OF TERTIARY BUTYL HYDROPEROXIDE.

DESCRIPTION OF THE INVENTION

This invention relates to a method of producing chlorine and organic compounds such as alcohols, aldehydes, acids, and ketones in an electrolytic cell and more particularly to a method of simultaneously producing chlorine at a reduced voltage and producing alcohols, aldehydes, acids, and ketones as by-products. In the electrolysis of aqueous chlorides, e.g., hydrochloric acid, sodium chloride, and potassium chloride, inter alia, in diaphragm cells according to the prior art, the anode reaction is:

$$2Cl^- \rightarrow Cl_2 + 2e^- \ (E^\circ = -1.36 \text{ volt})$$

and the cathode reaction is:

$$2H_2O + 2e^- \rightarrow H_2 + 2OH^- \ (E^\circ = -0.83 \text{ volt})$$

The overall reaction requires an applied voltage across the cell of at least 2.19 volts. The actual cell voltage may be considerably greater due to the chlorine overvoltage on the anode, the hydrogen overvoltage on the cathode, the IR voltage drop through the anolyte, the IR voltage drop through the catholyte, and the IR voltage drop through the diaphragm.

It has now been found, however, that the cell voltage of the reaction can be reduced and desirable by-products, such as alcohols and ketones, may be recovered where an organic oxidant containing peroxy bonds, such as an organic peracid, peroxide, or hydroperoxide, or a derivative thereof, e.g., alkali metal salts, is introduced into the catholyte and the cathodic reduction products of the oxidant are recovered as by-products.

The method of this invention may be used in an integrated petrochemical operation where the chloride feed is the condensed off-gas from a chlorocarbon synthesis process, the organic oxidant is tert-butyl hydroperoxide, and the cell products are chlorine, e.g., for chlorination of hydrocarbons, acetone, tert-butyl alcohol, e.g., for use as a petroleum additive, and water. The method of this invention may be used in chlorine and caustic soda production where the chloride feed is aqueous sodium chloride, the organic oxidant is an organic peracid, peroxide, or hydroperoxide, or the sodium salt thereof, and the cell products are chlorine, caustic soda, water, and the reduction products of the organic oxidant. The method of this invention may also be used in chlorine and potassium hydroxide production where the feed is aqueous potassium chloride, the organic oxidant is an organic peracid, peroxide, or hydroperoxide, or the potassium salt thereof, and the cell products are chlorine, potassium hydroxide, water, and the reduction products of the organic oxidant.

DETAILED DESCRIPTION OF THE INVENTION

This invention relates to a method of simultaneously producing chlorine at a reduced cell voltage and producing products such as acids, alcohols, aldehydes, and ketones. According to this invention, an aqueous chloride, e.g., sodium chloride brine, potassium chloride brine, or hydrochloric acid, is fed to the anolyte chamber of an electrolytic cell, e.g., a diaphragm cell or permionic membrane cell, a suitable organic oxidant is provided in the catholyte liquor, chlorine is recovered from the anolyte chamber of the cell and the cathodic reaction products of the organic oxidant are recovered from the catholyte chamber of the cell. In this way, hydrogen evolution on the cathode is suppressed and preferably substantially eliminated, protecting the cathode from hydrogen embrittlement and hydrogen migration, while reducing the cell voltage.

While a diaphragm is referred to herein, a permionic membrane may be interposed between the anolyte chamber and the catholyte chamber. Normally, the diaphragm will be fabricated of a material that is resistant to the anolyte liquor and the catholyte liquor as asbestos fiber, asbestos paper, or a fluorocarbon or chlorocarbon or fluorocarbon-chlorocarbon film. However, the method of this invention may also be used to reduce the cell voltage of an electrolytic cell where the anode and cathode are in the same electrolyte compartment, as in an electrolytic cell for the production of alkali metal chlorates.

Suitable organic oxidants are those organic compounds containing a reducible peroxy bond, C—O—O—. Suitable oxidants include organic peroxides, organic hydroperoxides, and organic peracids, also referred to as peroxy acids. One preferred group of organic oxidants are organic hydroperoxides. Particularly outstanding organic oxidants are organic hydroperoxides yielding alcohols that are soluble in water in all proportions, those hydroperoxides yielding alcohols that are of limited solubility in water, and those hydroperoxides yielding alcohols that are sparingly soluble in water. For example, particularly outstanding hydroperoxides are methyl hydroperoxide yielding methyl alcohol, ethyl hydroperoxide yielding ethyl alcohol, n-propyl hydroperoxide yielding n-propyl alcohol, i-propyl hydroperoxide yielding i-propyl alcohol, and t-butyl hydroperoxide yielding t-butyl alcohol. Also useful in the method of this invention are those hydroperoxides yielding alcohols of limited solubility in water such as n-butyl hydroperoxide yielding n-butyl alcohol, sec-butyl hydroperoxide yielding sec-butyl alcohol, i-butyl hydroperoxide yielding i-butyl alcohol, and t-pentyl hydroperoxide yielding t-pentyl alcohol. Alternatively, those hydroperoxides may be used which yield as cathodic reduction products sparingly soluble alcohols, such as n-pentyl hydroperoxide yielding n-pentyl alcohol, i-pentyl hydroperoxides yielding i-pentyl alcohols, s-pentyl hydroperoxides yielding s-pentyl alcohols, and neopentyl hydroperoxide yielding neopentyl alcohol as cathodic reduction products. Also useful are cumene hydroperoxide yielding cumyl alcohol and ethylbenzene hydroperoxide yielding methyl phenyl carbinol.

Another group of hydroperoxides useful in carrying out the method of this invention are dihydroperoxides. Dihydroperoxides yield glycols as a reaction product when added to the catholyte chamber of an electrolytic cell as herein contemplated. The preferred dihydroperoxides are those that are completely miscible in water or those that are at least partially soluble in water. The preferred dihydroperoxides are the dihydroperoxides of the $C_3$ to $C_{10}$ alkyls with the dihydroperoxides of the $C_6$ to $C_{10}$ alkyls being especially preferred. Such dihydroperoxides include hexane dihydroperoxide, heptane dihydroperoxide, octane dihydroperoxide, nonane dihydroperoxide, and decane dihydroperoxide.

While alcohols, ketones, aldehydes, and glycols are referred to herein, they may only be formed as intermediates and may be further reacted, as by dehydration to give olefines and ethers, or by reaction with other additives as organic acids to yield esters or to yield alkali metal salts of alcohols.

Where the intermediate product is an alcohol, the alcohol may be further reacted to yield ethers. The alcohol may be separated from the cell liquor and further reacted in order to form the ether, e.g., by reaction with an alkylating agent, e.g., an alkyl sulfate. Thus, where the organic oxidant is tertiary butyl hydroperoxide, the intermediate recovered from the catholyte compartment is tertiary butyl alcohol. The tertiary butyl alcohol may be removed from the cell, separated from the cell liquor, e.g., by distillation, and reacted with, e.g., methyl sulfate, to yield methyl tertiary butyl ether. Methyl tertiary butyl ether finds utility as an automotive fuel additive.

Particularly desired hydroperoxides are those yielding alcohols that are soluble in water in all proportions and are useful in various industrial processes, for example, t-butyl hydroperoxide yielding t-butyl alcohol as a cathodic reduction product, t-butyl alcohol being useful as an automotive anti-knock compound.

Dialkyl peroxides, having the formula $R_1OOR_2$ where $R_1$ and $R_2$ may be $—CH_3$, $—C_2H_5$, $—C_3H_7$, $—C_4H_9$, $—CH_2CH=CH_2$, or any other dialkyl peroxide soluble in water or soluble in organic solvents may be used in the method of this invention. In addition to the dialkyl peroxides, the polyoxides having the formula $R_1O_nR_2$, where n is 3 or 4 may be used in the method of this invention as may the cycloperoxides having the formula $R_1—O—O—R_2$.

Peroxy acids, also known as peracids, having the formula $R(CO_3H)$ where R may be —H, $—CH_3$, $—CH_2Cl$, $—C_2H_5$, $—(n—C_3H_7)$, $—(i—C_4H_9)$, $—(n—C_5H_{11})$, and any other peracid soluble in water or soluble in organic solvents may be used in this invention. Also, acyl peroxides or other peroxy acid precursors may be utilized in the method of this invention. Additionally, aryl diperoxy acids may be used in the method of this invention.

While the method of this invention is described with respect to organic oxidizers such as organic peroxides, organic hydroperoxides (having the general formula R—O—O—H) and organic peroxy acids (having the general formula $R(CO_3H)$), it is to be understood that various derivatives of the organic oxidizers may also be used. For example, the method of this invention may be practiced with salts of the organic oxidizers, e.g., salts of organic hydroperoxides (having the formula R—O—O—M) and salts of organic peroxy acids (having the formula $R(CO_3M)$), where M is a cationic species chosen from the group consisting of alkali metals, alkaline earth metals, and the ammonium radical. Of the alkali metals lithium, sodium, potassium, rubidium, and cesium, most frequently the alkali metal will be sodium or potassium. Of the alkaline earth metals beryllium, magnesium, calcium, strontium, and barium, most frequently the alkaline earth metal will be magnesium or calcium. Generally, when the catholyte liquor is an aqueous alkali metal hydroxide, MOH, the organic oxidizer either is the hydrogen form (e.g., R—O—O—H, R—O—O—R, $R(CO_3H)$), or the alkali metal salt (e.g., R—O—O—M, $R(CO_3M)$), where M is the same alkali metal in the hydroxide and the organic oxidizer.

The aqueous chlorides of most commercial interest that are useful in carrying out the method of this invention are those having the formula MCl where M is chosen from the group consisting of hydrogen, sodium, and potassium. However, other water soluble chlorides may by used in carrying out the method of this invention.

According to the method of this invention, the organic oxidant is added to the catholyte liquor. This may be done by feeding the oxidant directly into the catholyte chamber as through a conduit or a downcomer or an inlet pipe. The oxidant may be added below the surface of the catholyte liquor or above the surface of the catholyte liquor, for example, through an upward extending pipe in the bottom of the catholyte chamber with a sparger or distributor or bubble cap on top, or through a downcomer extending into the catholyte liquor with a sparger or distributor on the bottom or outlet thereof.

According to an alternative exemplification of this invention, where the diaphragm is spaced from the cathode, the oxidant may be fed into the electrolyte through a sparger interposed between the cathode and the diaphragm.

Alternatively, the oxidant, especially if it is a sparingly soluble material, may be added to the catholyte liquor under pressure at a high velocity, for example, to form a suspension or emulsion in the catholyte liquor.

Alternatively, the oxidant may be fed into the anolyte chamber, for example, with the brine feed or through separate feed line or downcomer and then transported through the diaphragm or permionic membrane with the anolyte liquor into the catholyte chamber.

According to still another exemplification of this invention, the oxidant may be fed into the catholyte chamber through the cathode. In such a case, the cathode may be hollow or porous. According to one embodiment of this exemplification, the cathode geometry is characterized by surfaces of different characteristics, i.e., a first portion wettable by catholyte liquor and intended to be in contact with and completely wetted by the aqueous electrolyte and a second portion wettable by the organic oxidant, non-wettable by the aqueous catholyte liquor, and intended to be in contact with the organic oxidant.

According to another exemplification of this invention, the oxidant passes through a hollow or porous cathode and is reduced within the cathode or as it passes from the cathode or the boundary layer surrounding the cathode into the catholyte liquor.

According to this exemplification, the cathode may be a porous carbon body having a porosity of from about 20 to about 80 percent and most commonly about 45 to 50 percent, a mean pore diameter of from about 0.00005 inch (1.25 micron) to about 0.005 inch (125 microns), and a minimum size of retained particle of from about 0.00002 inch (0.5 micron) to about 0.002 inch (50 microns).

According to still a further embodiment of this exemplification, an electrocatalyst may be provided within the pores of the porous carbon body, or on the external surfaces of the porous carbon body, e.g., on the external surface of the porous carbon body facing the anode. By an electrocatalyst is meant those materials that are resistant to attack by the catholyte liquor and capable of reducing the overvoltage of the cathode reaction. Typical electrocatalysts include the transition metals of Group VIII, iron, cobalt, nickel, palladium, ruthenium, rhodium, platinum, osmium, iridium, and compounds thereof. Other catalysts, such as copper, may be used.

Any metal of Group III*b*, IV*b*, V*b*, VI*b*, VII*b*, I*b*, II*b*, or III*a*, or alloys thereof, which metal or alloy is resistant to the catholyte, can be used as the cathode or coating on the cathode. Additionally, solid metalloids, e.g., phthalocyanines of the Group VIII metals, perovskites, spinels, delafossites, and pyrochlores, inter alia, may be used as the cathode.

The cathode itself may be permeable to the electrolyte or substantially impermeable to the electrolyte. For example, the cathode may be an electrolyte impermeable plate or sheet, or the cathode may be impermeable to microscopic flow of electrolyte but permeable to macroscopic flow of electrolyte, e.g., a foraminous sheet or plate or wire mesh. According to a still further exemplification of this invention, the cathode may be permeable to the flow of either electrolyte or gases or the oxidant, as a porous electrode.

According to still another exemplification of this invention, the cathode is in the form of a packed bed or fluidized bed, for example, a packed or fluidized bed of titanium having a suitable electrocatalytic coating thereon or a packed or fluidized bed of graphite particles. The particles or packing may be coated with an electrocatalytic coating as described hereinabove. In such an exemplification as herein contemplated, the oxidant may be passed upwardly through the bed, for example, upwardly through a fluidized bed or the oxidant may be passed downward through the bed.

The organic oxidant may be introduced into the cell as the pure organic oxidant, as an aqueous solution, emulsion or suspension, or in an organic solvent. The organic solvent need not be completely soluble in water, as, for example, when the solvent and oxidant are fed into a porous cathode. Surfactants may be added to the electrolyte to disperse the organic oxidant.

Preferably, the catholyte liquor is stirred, circulated, or otherwise agitated, as by recirculation or mixing or ultrasonic vibration to maintain the concentration of reactants and products substantially uniform therethrough. Thus, where an electrolyte impermeable cathode is used and the catholyte chamber is agitated, a further voltage reduction, e.g., about 0.3 or even 0.5 volt, may be obtained. For example, the cathode itself may be subject to ultrasonic vibration whereby to enhance the mass transfer of products and reactants. Where the organic oxidant is fed to and through a porous cathode, an inert gas, as $CO_2$ in an acid cell or $N_2$, may be admixed therewith to increase the flow rate therethrough while increasing the degree of agitation of the electrolyte.

The amount of oxidant added to the cell is high enough to avoid hydrogen evolution and is at least equal to the stoichiometric amount of oxidant that may be reduced at the cathode, that is, at least one equivalent of oxidant per Faraday of electrolytic current passed through the cell. In order to obtain a stoichiometric amount of oxidant, the feed rate of oxidant should be greater than the product of the feed rate of chloride to the cell, the decomposition, and the cathode current efficiency of the cell, and the feed rate of the oxidant is preferably greater than or equal to the product of the feed rate of chloride to the cell and the decomposition. A feed rate of oxidant greater than the product of the feed rate of chloride to the cell, the decomposition, and the current efficiency is high enough to avoid hydrogen evolution on the cathode. Feed rates of oxidant low enough to allow substantial hydrogen evolution should be avoided as such low feed rates will result in an increased voltage and possible decreased current efficiency. In order to be certain of substantially complete suppression of hydrogen evolution, an excess of oxidant may be fed to the cell. The excess oxidant may be recovered with and separated from the cell liquor and returned to the cell.

The decomposition is:

$$[(MOH)/(MOH) + (MCl)]$$

where (MCl) is the chloride content of the catholyte liquor and (MOH) is the hydroxide content, i.e., the potassium hydroxide content, or the sodium hydroxide content of the catholyte liquor. Generally, the percent decomposition is from about 25 percent to about 75 percent and preferably from about 40 percent to about 60 percent. Percentage decompositions greater than about 60 or even 75 percent result in a significantly reduced anode current efficiency while percent decompositions less than about 25 percent or even less than about 40 percent provide no increase in current efficiency but require additional evaporation and crystallization loads.

According to the method of this invention, the cathode reaction products of the oxidant are recovered from the catholyte chamber along with the cell liquor. The cathodic reduction products of the oxidant may be partially or totally gases or vapors such as methyl alcohol, ethyl alcohol, n-propyl alcohol, i-propyl alcohol, or t-butyl alcohol. Alternatively, the products may be liquids recovered with the cell liquor such as methyl alcohol, ethyl alcohol, n-propyl alcohol, i-propyl alcohol, t-butyl alcohol, sec-butyl alcohol, i-butyl alcohol, n-butyl alcohol, or t-pentyl alcohol, n-pentyl alcohol, i-pentyl alcohol, or amyl alcohol or the cathodic product may be emulsions or suspensions of excess amounts of sparingly soluble alcohols, such as sec-butyl alcohol, i-butyl alcohol, n-butyl alcohol, t-pentyl alcohol, n-pentyl alcohol, i-pentyl alcohol, or amyl alcohol. Where the cathodic reduction product of the oxidant is recovered either as a gas or as both a gas and a liquid such as methyl alcohol, ethyl alcohol, n-propyl alcohol, i-propyl alcohol, or t-butyl alcohol, the cathodic reduction product is separated from both the water vapor and gas phase and recovered. Alternatively, where the cathodic reduction product of the oxidant is recovered as a liquid, either in solution with water or as suspension or emulsion in water, such as methyl alcohol, ethyl alcohol, n-propyl alcohol, i-propyl alcohol, n-butyl alcohol, i-butyl alcohol, sec-butyl alcohol, t-butyl alcohol, t-pentyl alcohol, n-pentyl alcohol, i-pentyl alcohol, neopentyl alcohol, or s-pentyl alcohol, the cathodic reduction product may be separated from the cell liquor by methods well known in the art such as fractional distillation, extraction, adsorption, stripping, other phase separation techniques, or the like and recovered.

According to one exemplification of this invention, tertiary butyl alcohol is produced during the electrolysis of sodium chloride brine. In this exemplification of the invention, sodium chloride brine is fed to an anolyte chamber of an electrolytic cell, tertiary butyl hydroperoxide is fed to a catholyte chamber of the cell and an electrical current is passed from an anode of the cell to a cathode of the cell whereby chlorine is evolved at the anode and tertiary butyl alcohol and acetone are formed in the catholyte chamber. An aqueous catholyte liquor containing sodium hydroxide, tertiary butyl alcohol, acetone, and excess tertiary butyl hydroperoxide is recovered from the catholyte chamber of the cell.

As herein contemplated, sodium chloride brine is fed to the anolyte chamber of the cell and the organic hydroperoxide, e.g., tertiary butyl hydroperoxide, is fed to the catholyte chamber of the cell. The feed of the hydroperoxide may be direct, through a conduit or downcomer or riser, or through the cathode, such as a hollow or porous cathode or a packed or fluidized cathode. Alternatively, the organic hydroperoxide may be fed into the anolyte chamber and through the diaphragm into the catholyte chamber.

An electrical current is passed from an anode of the cell to a cathode of the cell whereby chlorine is evolved at the anode; and an alcohol, a glycol, a carbonyl compound, e.g., an aldehyde or ketone, and an alkali metal hydroxide, e.g., NaOH or KOH, are formed at the cathode. The following reactions occur:

$$2Cl^- \rightarrow Cl_2 + 2e^- \ (E = -1.36 \text{ volt})$$

$$(CH_3)_3COO^- + 2H_2O + 2e^- \rightarrow (CH_3)_3COH + 3OH^- \ (E = 0.4 \text{ volt})$$

Due to chlorine overvoltage on the anode, hydroperoxide overvoltage on the cathode and IR voltage drops across the anolyte liquor, catholyte liquor, and diaphragm, a minimum voltage of about 1.40 volt to about 2.0 volts or more, depending on the current density, must be applied across the cell to drive the reaction.

Thereafter, an aqueous catholyte cell liquor containing sodium hydroxide, tertiary butyl alcohol, a carbonyl, e.g., acetone, and excess tertiary butyl hydroperoxide, most likely as the sodium salt, is recovered from the cell. With a tertiary butyl hydroperoxide feed and a tertiary butyl alcohol product, an azeotrope may be formed upon evaporation and subsequent recovery and distillation of the cell liquor. This azeotrope contains 11.76 percent water and 88.24 percent tertiary butyl alcohol.

In the embodiment of this invention where an excess of tertiary butyl hydroperoxide is fed to the cell, the tertiary butyl alcohol recovered as an azeotrope, the hydroperoxide salt of sodium, e.g., $Na^+[(CH_3)_3COO^-]$, may be crystallized out of concentrated aqueous caustic soda solution, e.g., caustic soda solution containing in excess of 40 weight percent caustic soda. This sodium salt of tertiary butyl hydroperoxide may then be recirculated to the cell.

According to a further exemplification of this invention, the cell liquor may be fed to another cell, for example, to the catholyte chamber thereof, whereby to provide a catholyte liquor enhanced in alkali metal hydroxide content and diminished in organic oxidant content. The remaining organic oxidant may then be further reduced in the subsequent cell or cells, with the cell liquor, in order to produce more by-product, e.g., more ketone, aldehyde, acid, alcohol, or glycol, and a high strength alkali metal hydroxide solution.

According to another exemplification of this invention, tertiary butyl alcohol is produced during the recovery of condensed-off gas hydrochloric acid. The hydrochloric acid is separated from the hydrocarbons, chlorinated hydrocarbons, and chlorine recovered from a chlorinated hydrocarbon synthesis process. The hydrochloric acid is then introduced into the anolyte chamber of an electrolytic cell adapted for the electrolysis of hydrochloric acid to yield water and chlorine. Tertiary butyl hydroperoxide is fed to a catholyte chamber of the cell and an electrical current is passed from an anode of the cell to a cathode of the cell. Chlorine is evolved at the anode, and tertiary butyl alcohol and acetone are formed in the catholyte chamber. An aqueous catholyte liquor containing tertiary butyl alcohol and acetone is recovered from the catholyte chamber.

While this embodiment, where hydrochloric acid is electrolyzed to yield chlorine, has been illustrated with t-butyl hydroperoxide, it is to be understood that the use of an acid anolyte and an acid catholyte allows the organic oxidant to be a peroxy acid such as peracetic acid.

The organic oxidant, e.g., tertiary butyl hydroperoxide, may be fed through a conduit, or downcomer, or riser, or sparger. Alternatively, the organic oxidant may be fed into and through the cathode, i.e., a porous cathode such as a porous carbon body.

An aqueous catholyte liquor containing acetone and tertiary butyl alcohol is recovered from the catholyte chamber. The acetone and tertiary butyl alcohol may be recovered by methods well known in the prior art, as distillation.

Tertiary butyl alcohol finds utility as a high octane gasoline additive which may be blended with other feed stocks to give high octane gasoline. Tertiary butyl hydroperoxide may be obtained by the air oxidation of isobutane to tertiary butyl hydroperoxide.

While the exemplification of this invention, where a hydroperoxide is reduced to yield an alcohol, has been illustrated with respect to tertiary butyl hydroperoxide, other hydroperoxides, as enumerated hereinabove, could have served as the oxidant.

The following examples are illustrative.

EXAMPLE I

A series of comparative tests were run to determine the cathode potentials of hydrogen evolution in three normal sodium hydroxide solution and of tertiary butyl hydroperoxide reduction in three normal sodium hydroxide solution. The cell was a two-compartment diaphragm cell constructed of ½ inch thick plexiglass. Each compartment was 1¾ inch deep by 3 inches wide by 6 inches high, with a 1/16 inch by 1 inch by 5 inch diaphragm of 45 micron pore diameter porous polyethylene separating the anolyte chamber from the catholyte chamber. The catholyte liquor was stirred with magnetic stirring bars and a saturated calomel electrode was used as the reference electrode.

In each test, the catholyte chamber and the anolyte chamber were charged with 300 milliliters of three normal sodium hydroxide. All of the cathodes under test were 3/8 inch wide. The anode was platinized titanium mesh. Each run was done in two parts. In the first part, three normal caustic soda was fed to the catholyte and anolyte chambers of each cell. In the second part of each run, the electrolyte was built up by adding 40 milliliters of 70 percent tertiary butyl hydroperoxide to the catholyte and 60 milliliters of three normal sodium hydroxide to the anolyte liquor.

In each run, the current density was started at 30 amperes per square foot and gradually increased to 100 amperes per square foot. The system was run as a batch system with gradual depletion of the tertiary butyl hydroperoxide in the second portion of each run.

RUN A

In Run A, the cathode was sandblasted graphite. The current density, cell voltage, and cathode potential versus a saturated calomel electrode are shown for catholyte liquors of three normal sodium hydroxide catholyte liquor with and without tertiary butyl hydroperoxide added.

TABLE A

| Current Density Amperes per Square Foot | Catholyte: 3N NaOH Cell Voltage Volts | Catholyte: 3N NaOH Cathode Potential Volts vs. standard calomel electrode | Catholyte: 3N NaOH + t-butyl Hydroperoxide Cell Voltage Volts | Catholyte: 3N NaOH + t-butyl Hydroperoxide Cathode Potential Volts vs. standard calomel electrode |
|---|---|---|---|---|
| 30 | 2.42 | 1.63 | 1.83 | 1.11 |
| 40 | 2.51 | 1.66 | 1.99 | 1.18 |
| 50 | 2.59 | 1.68 | 2.15 | 1.24 |
| 60 | 2.69 | 1.70 | 2.31 | 1.29 |
| 70 | 2.78 | 1.72 | 2.44 | 1.34 |
| 80 | 2.86 | 1.73 | 2.56 | 1.36 |
| 90 | 2.94 | 1.74 | 2.71 | 1.40 |
| 100 | 3.00 | 1.76 | 2.80 | 1.43 |

RUN B

In the second run, the cathode was a rusty steel cathode. All other procedures were the same as in Run A.

TABLE B

| Current Density Amperes per Square Foot | Catholyte: 3N NaOH Cell Voltage Volts | Catholyte: 3N NaOH Cathode Potential Volts vs. standard calomel electrode | Catholyte: 3N NaOH + t-butyl hydroperoxide Cell Voltage Volts | Catholyte: 3N NaOH + t-butyl hydroperoxide Cathode Potential Volts vs. standard calomel electrode |
|---|---|---|---|---|
| 30 | 2.22 | 1.38 | 1.65 | 0.85 |
| 40 | 2.31 | 1.41 | 1.82 | 0.88 |
| 50 | 2.40 | 1.42 | 1.96 | 0.90 |
| 60 | 2.48 | 1.42 | 2.11 | 0.92 |
| 70 | 2.57 | 1.42 | 2.28 | 0.94 |
| 80 | 2.65 | 1.43 | 2.39 | 0.95 |
| 90 | 2.72 | 1.43 | 2.52 | 0.97 |
| 100 | 2.80 | 1.43 | 2.66 | 0.98 |

RUN C

In Run C, copper sheet was used as the cathode. All other procedures were as described for Run A above.

TABLE C

| Current Density Amperes per Square Foot | Catholyte: 3N NaOH Cell Voltage Volts | Catholyte: 3N NaOH Cathode Potential Volts vs. standard calomel electrode | Catholyte: 3N NaOH + t-butyl hydroperoxide Cell Voltage Volts | Catholyte: 3N NaOH + t-butyl hydroperoxide Cathode Potential Volts vs. standard calomel electrode |
|---|---|---|---|---|
| 30 | 2.41 | 1.58 | 1.35 | 0.39 |
| 40 | 2.52 | 1.60 | 1.54 | 0.40 |
| 50 | 2.58 | 1.62 | 1.67 | 0.47 |
| 60 | 2.68 | 1.63 | 1.84 | 0.53 |
| 70 | 2.77 | 1.65 | 1.99 | 0.63 |
| 80 | 2.85 | 1.66 | 2.13 | 0.64 |
| 90 | 2.95 | 1.69 | 2.20 | 0.66 |

TABLE C-continued

| Current Density Amperes per Square Foot | Catholyte: 3N NaOH Cell Voltage Volts | Catholyte: 3N NaOH Cathode Potential Volts vs. standard calomel electrode | Catholyte: 3N NaOH + t-butyl hydroperoxide Cell Voltage Volts | Catholyte: 3N NaOH + t-butyl hydroperoxide Cathode Potential Volts vs. standard calomel electrode |
|---|---|---|---|---|
| 100 | 3.02 | 1.69 | 2.30 | 0.65 |

RUN D

In Run D, Grade 314 stainless steel was used as the cathode. All other procedures were as described in Run A above.

TABLE D

| Current Density Amperes per Square Foot | Catholyte: 3N NaOH Cell Voltage Volts | Catholyte: 3N NaOH Cathode Potential Volts vs. standard calomel electrode | Catholyte: 3N NaOH + t-butyl hydroperoxide Cell Voltage Volts | Catholyte: 3N NaOH + t-butyl hydroperoxide Cathode Potential Volts vs. standard calomel electrode |
|---|---|---|---|---|
| 30 | 2.32 | 1.42 | 1.85 | 1.07 |
| 40 | 2.40 | 1.44 | 2.01 | 1.12 |
| 50 | 2.46 | 1.44 | 2.13 | 1.16 |
| 60 | 2.55 | 1.45 | 2.26 | 1.20 |
| 70 | 2.61 | 1.45 | 2.39 | 1.23 |
| 80 | 2.67 | 1.45 | 2.51 | 1.27 |
| 90 | 2.75 | 1.46 | 2.61 | 1.29 |
| 100 | 2.82 | 1.46 | 2.71 | 1.30 |

RUN E

In Run E, a ruthenium dioxide coated titanium sheet was used as the cathode. All other procedures were as described in Run A above.

TABLE E

| Current Density Amperes per Square Foot | Catholyte: 3N NaOH Cell Voltage Volts | Catholyte: 3N NaOH Cathode Potential Volts vs. standard calomel electrode | Catholyte: 3N NaOH + t-butyl hydroperoxide Cell Voltage Volts | Catholyte: 3N NaOH + t-butyl hydroperoxide Cathode Potential Volts vs. standard calomel electrode |
|---|---|---|---|---|
| 30 | 2.02 | 1.16 | 1.74 | 0.93 |
| 40 | 2.09 | 1.18 | 1.80 | 0.95 |
| 50 | 2.15 | 1.19 | 1.97 | 0.96 |
| 60 | 2.23 | 1.20 | 2.10 | 0.97 |
| 70 | 2.29 | 1.20 | 2.23 | 0.98 |
| 80 | 2.35 | 1.20 | 2.33 | 1.00 |
| 90 | 2.42 | 1.20 | 2.47 | 1.02 |
| 100 | 2.47 | 1.20 | 2.59 | 1.04 |

RUN F

In Run F, a platinum coated graphite was used as the cathode. All other procedures were as described in Run A above. The results are as shown in Table F below.

TABLE F

| Current Density Amperes per Square Foot | Catholyte 3N NaOH Cell Voltage Volts | Catholyte 3N NaOH Cathode Potential Volts vs. standard calomel electrode | Catholyte: 3N NaOH + t-butyl hydroperoxide Cell Voltage Volts | Catholyte: 3N NaOH + t-butyl hydroperoxide Cathode uz,26/32 Potential Volts vs. standard calomel electrode |
|---|---|---|---|---|
| 30 | 1.90 | 1.06 | 0.94 | 0.28 |
| 40 | 1.97 | 1.08 | 1.09 | 0.29 |

TABLE F-continued

| Current Density Amperes per Square Foot | Catholyte 3N NaOH Cell Voltage Volts | Catholyte 3N NaOH Cathode Potential Volts vs. standard calomel electrode | Catholyte: 3N NaOH + t-butyl hydroperoxide Cell Voltage Volts | Catholyte: 3N NaOH + t-butyl hydroperoxide Cathode uz,26/32 Potential Volts vs. standard calomel electrode |
|---|---|---|---|---|
| 50 | 2.03 | 1.08 | 1.21 | 0.31 |
| 60 | 2.11 | 1.10 | 1.31 | 0.31 |
| 70 | 2.17 | 1.11 | 1.42 | 0.31 |
| 80 | 2.24 | 1.12 | 1.54 | 0.35 |
| 90 | 2.31 | 1.12 | 1.65 | 0.36 |
| 100 | 2.38 | 1.14 | 1.78 | 0.37 |

After the tertiary butyl hydroperoxide in the catholyte liquor was substantially decomposed, an additional 10 milliliters of tertiary butyl hydroperoxide were added to the catholyte liquor and electrolysis resumed at 30 amperes per square foot and gradually built up to 100 amperes per square foot. The addition was necessitated by the appearance of hydrogen bubbles on the cathode. The following results were obtained:

TABLE F-1

| Current Density Amperes per Square Foot | Catholyte: 3N NaOH + t-butyl hydroperoxide Cell Voltage | Catholyte: 3N NaOH + t-butyl hydroperoxide Cathode Potential Volts vs. standard calomel electrode |
|---|---|---|
| 30 | 0.92 | 0.13 |
| 40 | 1.03 | 0.13 |
| 50 | 1.12 | 0.14 |
| 60 | 1.24 | 0.16 |
| 70 | 1.35 | 0.17 |
| 80 | 1.42 | 0.18 |
| 90 | 1.52 | 0.18 |
| 100 | 1.64 | 0.22 |

Run F shows the effect of depletion of tertiary butyl hydroperoxide on the cathode voltage and cell voltage.

RUN G

In Run G, a rhodium plated graphite cathode was used and the procedure described in Run A above was followed. The results shown in Table G, below, was obtained.

TABLE G

| Current Density Amperes per Square Foot | Catholyte: 3N NaOH Cell Voltage Volts | Catholyte: 3N NaOH Cathode Potential Volts vs. standard calomel electrode | Catholyte: 3N NaOH + t-butyl hydroperoxide Cell Voltage Volts | Catholyte: 3N NaOH + t-butyl hydroperoxide Cathode Potential Volts vs. standard calomel electrode |
|---|---|---|---|---|
| 30 | 190 | 1.07 | 1.06 | 0.28 |
| 40 | 1.96 | 1.08 | 1.21 | 0.29 |
| 50 | 2.01 | 1.08 | 1.33 | 0.31 |
| 60 | 2.08 | 1.09 | 1.46 | 0.32 |
| 70 | 2.16 | 1.10 | 1.58 | 0.34 |
| 80 | 2.22 | 1.11 | 1.66 | 0.34 |
| 90 | 2.28 | 1.11 | 1.77 | 0.37 |
| 100 | 2.34 | 1.12 | 1.90 | 0.39 |

RUN H

In Run H, the cathode was a palladium coated graphite cathode. The procedure described in Run A above was followed and the results shown in Table H, below, were obtained.

TABLE H

| Current Density Amperes per Square Foot | Catholyte: 3N NaOH Cell Voltage Volts | Catholyte: 3N NaOH Cathode Potential Volts vs. standard calomel electrode | Catholyte: 3N NaOH + t-butyl hydroperoxide Cell Voltage Volts | Catholyte: 3N NaOH + t-butyl hydroperoxide Cathode Potential Volts vs. standard calomel electrode |
|---|---|---|---|---|
| 30 | 2.12 | 1.27 | 0.94 | 0.16 |
| 40 | 2.23 | 1.31 | 1.06 | 0.16 |
| 50 | 2.31 | 1.33 | 1.18 | 0.17 |
| 60 | 2.48 | 1.35 | 1.28 | 0.17 |
| 70 | 2.48 | 1.36 | 1.37 | 0.17 |
| 80 | 2.55 | 1.37 | 1.49 | 0.17 |
| 90 | 2.62 | 1.39 | 1.56 | 0.17 |
| 100 | 2.69 | 1.39 | 1.67 | 0.18 |

EXAMPLE II

An electrolytic cell was constructed having an anode, a porous graphite cathode, and a diaphragm therebetween. Sodium chloride brine was fed to the anolyte chamber, a liquid composition of sodium chloride, sodium hydroxide, and tertiary butyl hydroperoxide was fed to the catholyte chamber and electrolysis was commenced. Gas was observed to be evolved at the anode.

a. Preparation of Anode

A porous graphite anode was prepared from a 6.5 centimeter diameter, 1.5 centimeter thick grade 45G porous graphite cylinder having a porosity of 0.48 and a mean pore diameter of 0.0019 inch (50 microns). The circumference of the cylinder was then wrapped with one coil of 18 gauge platinum wire.

The graphite cylinder was placed in a 10 percent solution of aqueous hydrochloric acid, the hydrochloric acid was drawn through the cylinder by vacuum, and then the cylinder was allowed to soak in aqueous hydrochloric acid for 16 hours. The cylinder was then flushed with distilled water, rinsed twice with acetone, and dried by vacuum at room temperature after each flush with acetone. The cylinder was then purged with air for two hours and 15 minutes.

A plating solution was prepared by diluting J. Bishop and Company "DNS Platinum Plating Solution" $H_2Pt(NO_2)_2SO_4$ with nine parts of distilled water to obtain a solution containing approximately five grams of platinum per liter. The porous graphite cylinder was placed in the plating solution and plated at a current of 0.18 amperes for one hour at a temperature of 38° C.

The porous graphite cylinder was then removed from the electroplating solution, rinsed in water, rinsed in acetone, and dried.

A hole was then drilled through the center of the cylinder and a six millimeter outside diameter glass tube was inserted in the hole.

b. Diaphragm and Anode

The diaphragm was 62 mil asbestos paper with a 34 millimeter diameter open area, the balance of its area being covered by a gasket. The anode was titanium mesh with a ruthenium dioxide-titanium dioxide coating. The anode was circular, 40 millimeters in diameter, and spaced 7 millimeters from the diaphragm.

c. Electrolytic Cell

The electrolytic cell was a two-part glass bodied cylindrical cell, two inches (5.08 centimeters) in diameter. The two parts were joined together with the diaphragm and cathode therebetween. The cathode was spaced 10.5 millimeters from the diaphragm with gaskets interposed between the glass body and the cathode and between the cathode and the diaphragm.

d. Preparation of Electrolytes

The brine feed was a solution of 305 grams per liter of analytical grade sodium chloride in distilled water.

The catholyte solution was prepared from (1) 240 milliliters of a 500 gram per liter solution of sodium hydroxide, (2) 540 milliliters of a 305 gram per liter solution of sodium chloride, (3) 153 milliliters of an aqueous solution of 70 weight percent tertiary butyl hydroperoxide, and (4) sufficient distilled water to provide a 1250 milliliter solution.

e. Cell Operation

Catholyte was continuously fed to the cell behind the cathode at a rate of 2.7 milliliters per minute and was allowed to pass through the porous cathode and collect between the cathode and the diaphragm. Catholyte was continuously withdrawn from the cell through the glass tube in the center of the cathode. Anolyte was continuously fed to the cell at a rate of 0.36 milliliter per minute. The anolyte temperature was initially 50° C. and the catholyte temperature was initially 29° C.

Electrolysis was commenced. Chlorine was recovered from the anolyte chamber and an aqueous liquid composition containing sodium chloride, sodium hydroxide, tertiary butyl hydroperoxide, tertiary butyl alcohol, and acetone was recovered from the catholyte chamber.

The following voltage/current density behavior was observed:

| Cell Voltage (volts) | Current Density (amperes per square foot) |
|---|---|
| 1.305 | 6.7 |
| 1.431 | 13.4 |
| 1.524 | 20.0 |
| 1.622 | 26.7 |
| 1.708 | 33.3 |
| 1.772 | 40.0 |
| 1.838 | 46.8 |
| 1.906 | 53.3 |
| 1.969 | 60.0 |
| 2.040 | 67.0 |
| 2.089 | 73.6 |
| 2.149 | 80.0 |
| 2.206 | 87.0 |
| 2.269 | 93.6 |
| 2.328 | 100 |
| 0.965 | open circuit |

While the method of this invention has been described with respect to specified cell geometries and oxidants, it is not intended to be so limited but is to be limited only as defined in the claims herein appended.

I claim:

1. In a method of electrolyzing an aqueous chloride solution comprising the steps of feeding the solution to an anolyte chamber of an electrolytic cell, imposing an electrical potential across said cell whereby to cause an electrical current to pass from an anode of said cell to a cathode of said cell whereby to evolve chlorine on said anode, and recovering chlorine gas from the anolyte chamber of said cell, the improvement comprising reducing said electrical potential by:

feeding a water soluble organic oxidant having a reducible peroxy bond to a catholyte chamber of said cell at a rate sufficient to suppress hydrogen evolution at the cathode thereof whereby to reduce the cell voltage at least about 0.3 volt; and recovering the cathodic reaction products of the oxidant from the catholyte chamber.

2. The method of claim 1 wherein the organic oxidant is chosen from the group consisting of hydroperoxides, dihydroperoxides, peroxides, peroxy acids, and derivatives thereof.

3. The method of claim 2 wherein the organic oxidant is a hydroperoxide.

4. The method of claim 2 wherein the organic oxidant is an alkali metal salt of a hydroperoxide.

5. The method of claim 1 wherein the aqueous chloride solution is chosen from the group consisting of hydrochloric acid, sodium chloride, and potassium chloride.

6. The method of claim 1 comprising feeding the organic oxidant to an electrolyte permeable cathode.

7. The method of claim 1 comprising feeding the organic oxidant to an electrolytic cell having an electrolyte impermeable cathode.

8. In a method of electrolyzing an aqueous sodium chloride brine comprising the steps of feeding the brine to an electrolytic cell, imposing an electrical potential across said cell whereby to cause an electrical current to pass from an anode of said cell to a cathode of said cell whereby to evolve chlorine on the anode of said cell, and recovering chlorine gas from an anolyte chamber of said cell and cell liquor containing sodium hydroxide from a catholyte chamber of said cell, the improvement comprising reducing said electrical potential by:

feeding a water soluble organic oxidant having a reducible peroxy bond to the catholyte chamber of the cell at a rate sufficient to suppress the formation of hydrogen at said cathode whereby to reduce the cell voltage at least about 0.3 volt; and recovering sodium hydroxide and the cathodic reaction products of the oxidant from the catholyte chamber.

9. The method of claim 8 wherein the organic oxidant is chosen from the group consisting of organic hydroperoxides, organic dihydroperoxides, organic peroxides, organic peroxy acids, and derivatives thereof.

10. The method of claim 9 wherein the oxidant is an organic hydroperoxide yielding a water soluble alcohol as a cathodic reaction product.

11. The method of claim 9 wherein the organic hydroperoxide is chosen from the group consisting of methyl hydroperoxide, ethyl hydroperoxide, n-propyl hydroperoxide, i-propyl hydroperoxide, t-butyl hydroperoxide, sec-butyl hydroperoxide, i-butyl hydroperoxide, n-butyl hydroperoxide, t-pentyl hydroperoxide, n-pentyl hydroperoxide, sec-pentyl hydroperoxide, i-pentyl hydroperoxide, neopentyl hydroperoxide, crotyl hydroperoxide, cumene hydroperoxide, ethyl benzene hydroperoxide, and alkali metal salts thereof.

12. The method of claim 11 wherein the oxidant is t-butyl hydroperoxide and the cathodic reaction products of the oxidant are t-butyl alcohol, and acetone.

13. The method of claim 8 comprising recovering sodium hydroxide, unreacted organic oxidant, and cathodic reaction products of the organic oxidant from the catholyte chamber and thereafter feeding unreacted oxidant to the catholyte chamber of another electrolytic cell.

14. A method of producing chlorine and alcohol comprising the steps of:

feeding hydrochloric acid to an anolyte chamber of an electrolytic cell;

feeding a water soluble organic oxidant having a reducible peroxy bond to a catholyte chamber of said cell at a rate sufficient to suppress hydrogen evolution at the cathode;

passing an electrical current from an anode of said cell to a cathode of said cell whereby chlorine is evolved at the anode and the organic oxidant is reduced in the catholyte; and recovering chlorine from the anolyte chamber and the reduction products of the organic oxidant from the catholyte chamber.

15. A method of producing tertiary butyl alcohol comprising the steps of:

feeding an aqueous chloride solution to an anolyte chamber of an electrolytic cell;

feeding tertiary butyl hydroperoxide through a porous cathode to a catholyte chamber of said cell at a rate sufficient to suppress the formation of hydrogen at the cathode;

passing an electrical current from an anode of said cell to said cathode of said cell whereby chlorine is evolved at the anode and tertiary butyl alcohol is formed in the catholyte liquor; and recovering an aqueous catholyte cell liquor containing tertiary butyl alcohol from the catholyte chamber of said cell.

16. The method of claim 15 comprising reacting the tertiary butyl alcohol with an alkyl sulfate whereby to form alkyl tertiary butyl ether.

17. A method of producing an alcohol comprising the steps of:

feeding an aqueous chloride solution to an anolyte chamber of an electrolytic cell;

feeding a soluble organic hydroperoxide to a catholyte chamber of said cell at a rate sufficient to suppress the formation of hydrogen at the cathode;

passing an electrical current from an anode to said cell to said cathode of said cell whereby chlorine is evolved at the anode and tertiary butyl alcohol is formed in the catholyte liquor; and recovering an aqueous catholyte cell liquor containing alcohol from the catholyte chamber of said cell.

18. The method of claim 17 comprising reacting the alcohol with an alkylating agent whereby to form an alkyl ether of the alcohol.

* * * * *